US005647069A

United States Patent [19]

Han et al.

[11] Patent Number: 5,647,069

[45] Date of Patent: Jul. 15, 1997

[54] ADJUSTABLE PERSONAL HYGIENE SYSTEM

[76] Inventors: Steven Han, 1224 Correia Pl., Manteca, Calif. 95337; Kwi Soup Chong, 450-40 Chunhodong, Kangdong Ku, Seoul, Rep. of Korea

[21] Appl. No.: 425,378

[22] Filed: Apr. 20, 1995

[51] Int. Cl.[6] ..... E03D 9/08

[52] U.S. Cl. ..... 4/420.2; 4/420.4; 4/447

[58] Field of Search ..... 4/420.2, 420.4, 4/420.5, 447, 448

[56] References Cited

U.S. PATENT DOCUMENTS

| | | | |
|---|---|---|---|
| 1,455,905 | 5/1923 | Cook | 4/420.4 |
| 2,875,450 | 3/1959 | Umann | 4/447 |
| 3,914,804 | 10/1975 | Schrader et al. | 4/420.4 X |
| 4,691,391 | 9/1987 | Kuo | 4/447 |
| 5,210,885 | 5/1993 | Ruo | 4/420.2 |
| 5,279,001 | 1/1994 | Vento | 4/447 |

*Primary Examiner*—Robert M. Fetsuga

[57] ABSTRACT

A bidet apparatus includes a base plate fitted to an upper horizontal rim surface of a conventional toilet. A rear nozzle block is pivotally mounted to the base plate and includes two separate water inlets connected to two separate nozzles. Each nozzle includes a plurality of holes to spray water at an angle at the posterior and genital areas of a user. Two valves are mounted to the base plate each having one inlet connectable to a pressurized water source, and one outlet, with each of the outlets being connected to a respective one of the separate water inlets. Conduits connect the separate water inlets to the valve outlets. A position handle is mounted to the base plate and includes a handle shaft moveable in back and forth motion for adjusting the position of the rear nozzle block. A linkage is connected between the rear nozzle block and the position handle for moving the rear nozzle block to an in-use position in response to movement of the handle shaft.

11 Claims, 5 Drawing Sheets

37
73
38
47
72
46
28
29
40
43
40
42
41
37
32
38
31
32
33
31A
31
30

73
37
47
72
28
46
40
29
43
40
42
41
37
31
38
32
33
31A
31
30

ADJUSTABLE PERSONAL HYGIENE SYSTEM

BACKGROUND OF THE INVENTION

1. Field of the Invention

This invention relates generally to a bidet apparatus and more particularly concerns a personal hygiene apparatus which is adapted for attachment to a conventional bathroom toilet seat or bowl.

2. Description of the Prior Art

This invention relates to a personal hygiene, and in particular is for cleaning a person's posterior or genital areas by flushing them with a spray of water. It can be used following use of the toilet, without further undressing. Bidets are well known and have long been used in certain parts of the world as a device for feminine personal hygiene. Although the advantages of the bidet are becoming well recognized in the United States, it have not become commonplace in the private residences, because of the expense in the installation of a separate bidet and, more importantly, there is usually insufficient bathroom space to install a separate bidet.

There have been proposals to overcome the problem of space by incorporating a bidet in a conventional toilets. Such devices disclosed in the following patents include a spray pipe that is moveable between a retracted position and an in-use position, a valve for control the flow of water and a rotatable handle.

| Inventor | U.S. Pat. No. |
|---|---|
| Joyce H. Bass | 4,926,509 |
| Peter Butterfield | 4,197,594 |
| Boring Jr | 4,642,820 |
| Miyanags | 4,334,329 |
| Ruiz | 4,181,985 |
| Guidetti | 1,966,951 |
| Callejo | 1.855,008 |
| Farley | 1,818,388 |
| Campus | 1,663,111 |

SUMMARY OF THE INVENTION

The bidet apparatus of the present invention includes two nozzle blocks, front nozzle block and rear nozzle block, that are located under the toilet seat. Rear nozzle block is in the middle of the rear area and has two separate sections of nozzle, which are an upper nozzle and a lower nozzle. Upper nozzle is located on the main body of the rear nozzle block and has nozzle holes with an angle to directing a spray of water at the posterior areas. Lower nozzle is located on a lower shaft of the rear nozzle block and has nozzle holes with an angle to directing a spray of water at the genital areas. Lower shaft is coming out from the rear nozzle block to the in-use position when the water pressure is applied and is back to the retracted position when the water is turned off. Upper nozzle and lower nozzle are connected to an independent water hose to direct a spray of water at the genital and posterior areas respectively from the rear side. Front nozzle block is located in the middle of the front area and has one front nozzle shaft with nozzle holes to direct a spray of water at the genital area from the front side. The front nozzle shaft is coming out from the front nozzle block to the in-use position when the water pressure is applied and is back to the retracted position when the water is turned off. Two valves are mounted on a control box to control the pressure for the spray of water at the genital and posterior areas respectively. Each of the valves has one inlet and one outlet. All inlet valves are jointed together and connected to the main water supply line of the toilet water tank with a T connector. Valve outlets are connected to upper nozzle, front nozzle shaft and lower nozzle respectively with independent water hose. The rear nozzle block is connected to a position screw block with a flexible link wire, such as a brake wire on the bicycle, to adjust the rear nozzle block position. By mining a screw block knob in clock wise or counter-clock wise, the rear nozzle block location can be changed in back and forth. And also, as the body of the position screw block is mounted to a base plate with a spring, the rear nozzle block can be swingable in back and forth by push and release the screw block knob. Screw block knob is located on the control box.

It is contemplated to install a water reservoir in the control box to make a warm water. The water reservoir is made with a heat resist plastic and is equipped with inlet, outlet, a heater and temperature sensors. The inlet of the water reservoir is connected to the main water supply line of the toilet water tank with a T connector. The heater and temperature sensors are connected to an electric control board to control the water temperature. A water temperature control panel is on a control box to adjust the spray of water temperature. It is another contemplated to install another type of water reservoir, which includes hot reservoir inlet, cold reservoir inlet and mixed reservoir outlet. Hot reservoir inlet is connected to normal hot water outlet with a hot water valve. Cold reservoir inlet is connected to normal cold water outlet with a cold water valve. Normal hot and cold water outlets are available in a bathroom. Mixed reservoir outlet is connected to valve inlets.

BRIEF DESCRIPTION OF THE DRAWING

A more thorough understanding of the invention may be obtained by a study of the following detailed description taken in connection with the accompanying drawings in which.

DESCRIPTION OF THE PREFERRED EMBODIMENT

Figure 1:
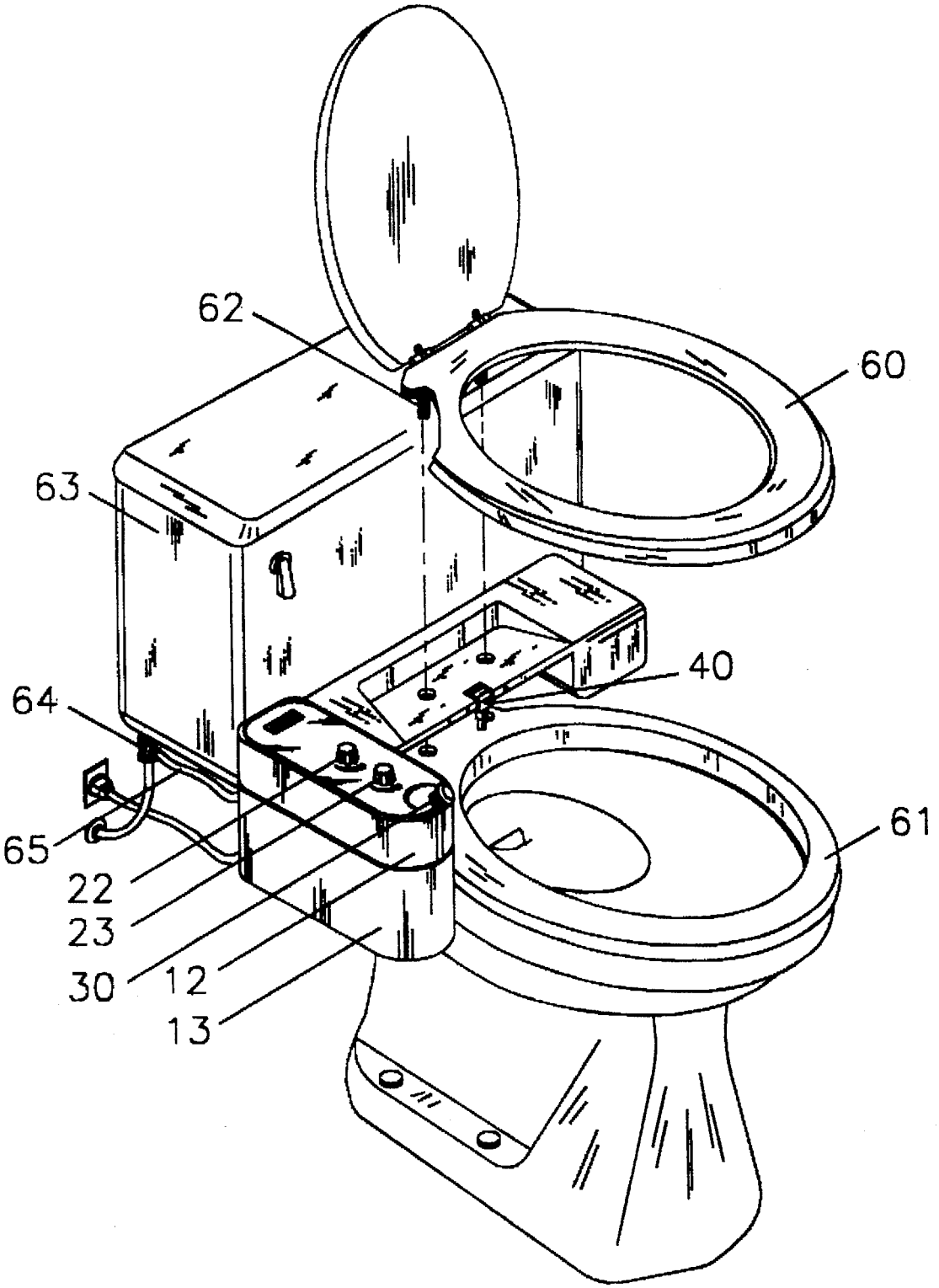
FIG. 1 is an elevational view showing the way to attach the bidet apparatus of the present invention to a conventional toilet.
Figure 2:
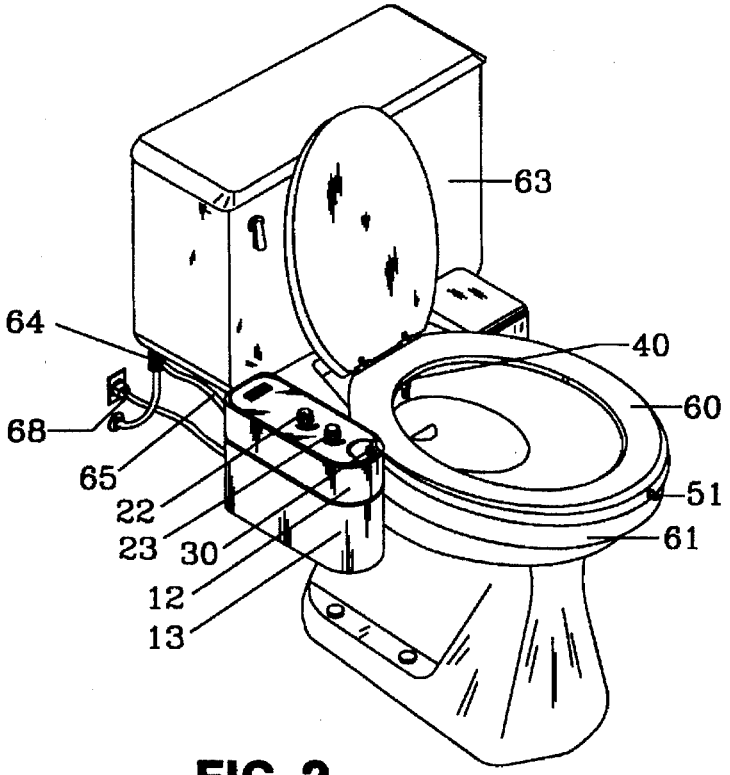
FIG. 2 is a perspective view of the bidet apparatus of the present invention attached to a conventional toilet.
Figure 3:
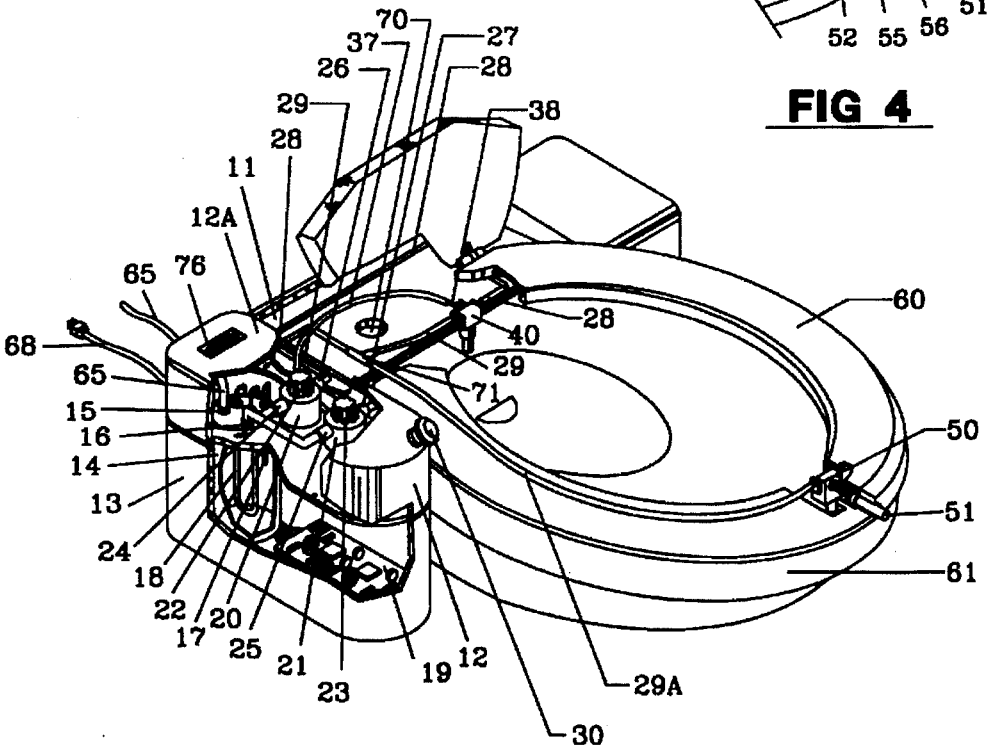
FIG. 3 is a perspective view showing in detail the relationship between the front and rear nozzle block, two valves and a portion of the water reservoir of the present invention.

Referring to FIGS. 1–3, the present invention is shown in an environment of a conventional toilet. Briefly the bidet apparatus, which is shown in FIG. 3, includes a front nozzle block 50, a rear nozzle block 40, control box 12, and a base plate 11 that is mounted to a toilet bowl 61 by toilet seat bolts 62. Base plate 11 includes an extended portion 35 that extends outwardly of the toilet bowl 61 structure and upon which control box 12 is mounted. Base plate 11 also includes two support blocks 73 positioned in the middle of the front area to mount a rear nozzle block 40 under the toilet seat 60, in the middle of the rear area.

Figure 5:
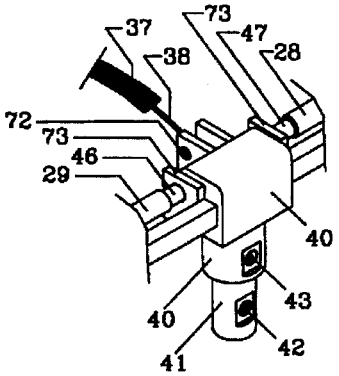
FIG. 5 is a perspective view of the rear nozzle block mounted on the base plate of the present invention.
Figure 6:
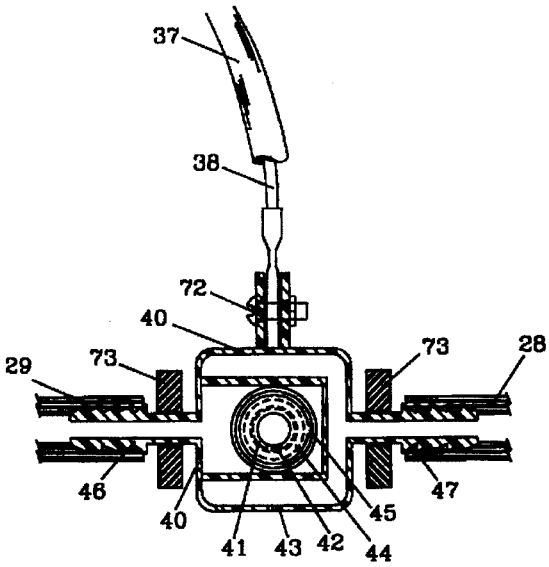
FIG. 6 is a top cross-section view of the rear nozzle block showing in detail the connection of two independent water hoses to the separate section of nozzle holes of the bidet apparatus.
Figure 7:
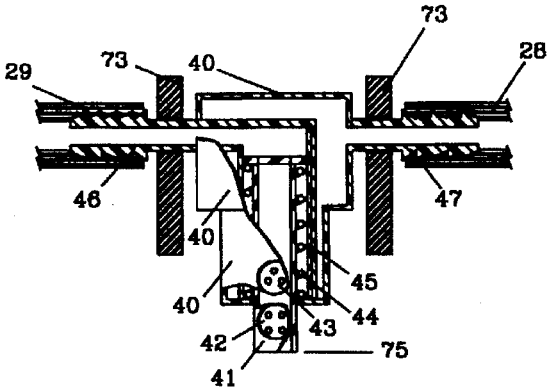
FIG. 7 is a front cross-section view of the rear nozzle block showing in detail the connection of two independent water hoses to the separate section of nozzle holes and the lower shaft is in the retracted position.
Figure 8:
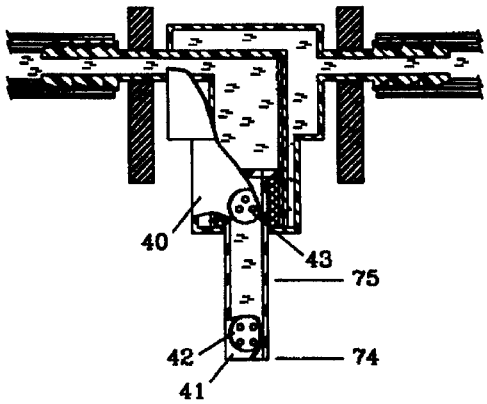
FIG. 8 is a front cross-section view of the rear nozzle block showing in detail the connection of two independent water hoses to the separate section of nozzle holes and the lower shaft is in the in-use position by the water pressure.
Figure 9:
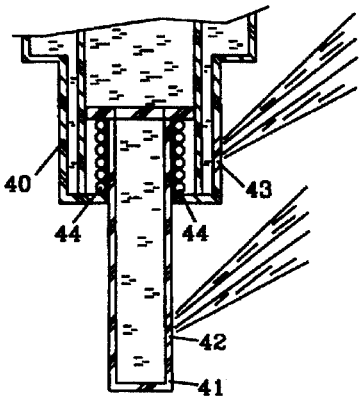
FIG. 9 is a side cross-section view of the rear nozzle block showing in detail the way of spray of water coming out from the upper and lower nozzle and the lower shaft is in the in-use position.

FIG. 5 show that rear nozzle block 40 includes a left water input shaft 46 on left side to supply water to lower nozzle 42 and right water input shaft 47 on right side to supply water to upper nozzle 43. The outside diameter of water input shafts 46, 47 are sized to be inserted into and be swingable on the mounting holes of the support blocks 73. Rear nozzle block 40 is mounted between two support blocks 73 with water input shafts 46, 47. The base plate area between support blocks 73 is opened to have rear nozzle block 40 be swingable. FIGS. 6–9 showing in details the inside of rear nozzle block 40 that includes left water input shaft 46, right water input shaft 47, a upper nozzle 43 for directing a spray of water at the posterior areas and a lower shaft 41 which includes a lower nozzle 42 to direct a spray of water at the genital area. Water flow for lower nozzle 42 and upper nozzle 43 are separated completely by using different line of water hoses, 28, 29 and by insulating the water flow sections at the inside of rear nozzle block 40. Lower water hose 29 is connected from lower nozzle valve 21 on control box 12 to left water input shaft 46, which is connected to inside of lower shaft 41 to supply water to lower nozzle 42. Inside of lower shaft 41 is part of the water flow path. Upper water hose 28 is connected from upper nozzle valve 20 on control box 12 to right water input shaft 47, which is connected to inside of main body section 40 to supply water to upper nozzle 43. Both nozzles 42, 43 have holes to spray water, and each of holes has a hole angle to direct a spray of water at the posterior and the genital areas respectively as shown in FIG. 9. Lower shaft 41 is mounted with a spring 44 in the middle of rear nozzle block 40 and is movable between a retracted position 75 as shown in FIG. 7 and in-use position 74 as shown in FIG. 8 to keep lower shaft 41 clean from contamination.

When turning the water on with a lower nozzle knob 23, the water pressure moves lower shaft 41 to in-use position 74 and sprays water at the genital areas from the rear side. When turning the water off with lower nozzle knob 23, lower shaft 41 returns to a retracted position 75 by the spring 44 force. Lower shaft 41 section includes a guider 45 to guide lower shaft 41 linearly without rotation when it moves vertically between its in-use position 74 and the retracted position 75.

Figure 4:
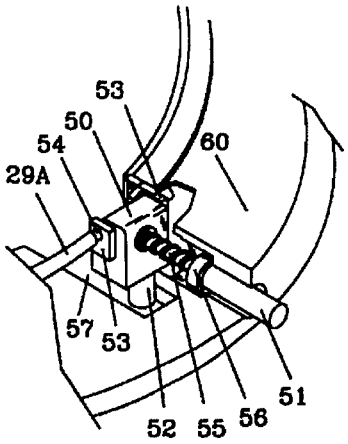
FIG. 4 is a perspective view of the front nozzle block mounted inside of the toilet seat.
Figures 10, 11, 12:
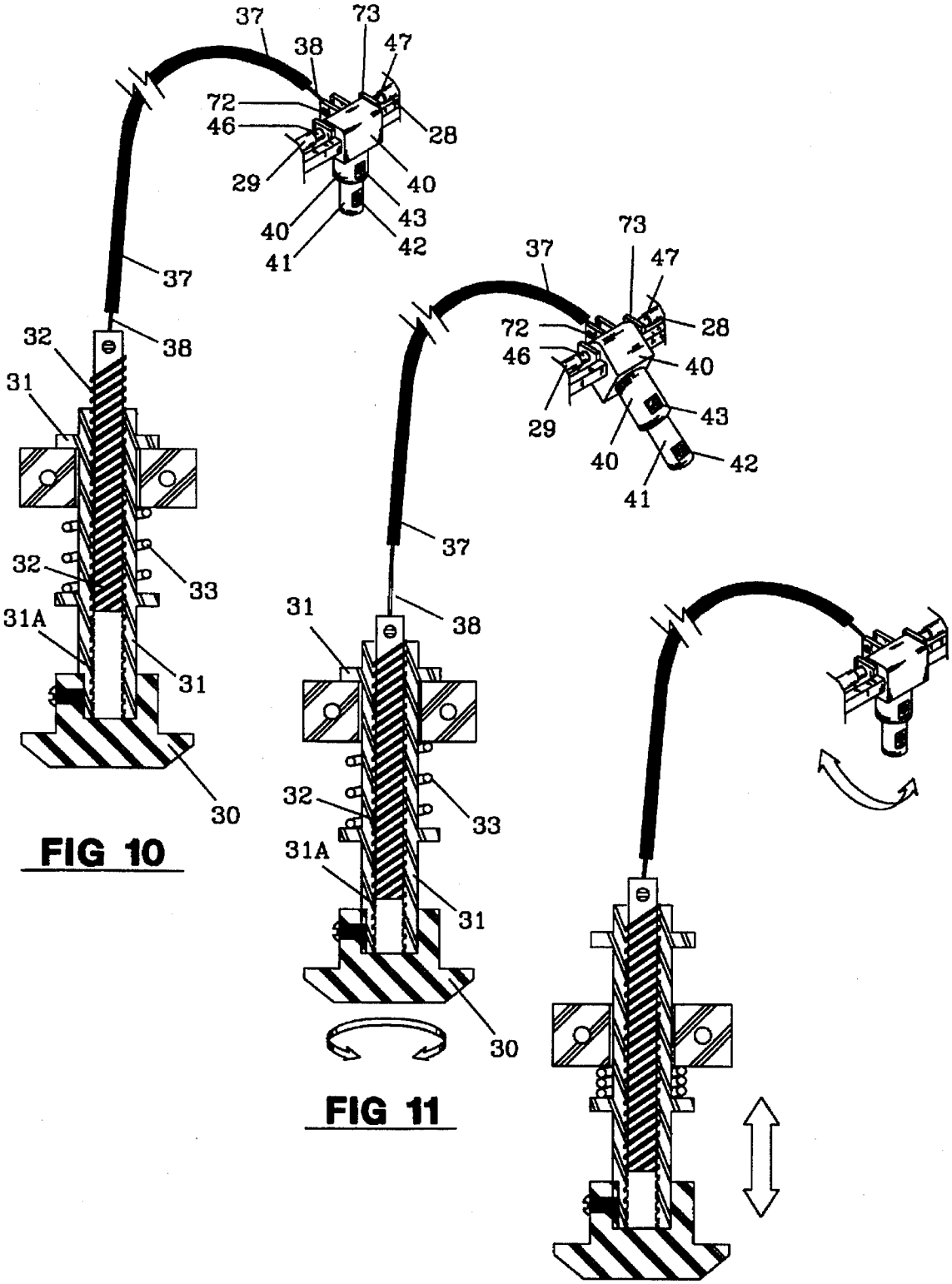
FIG. 10 is a perspective, partially cross-sectional, view showing in detail the relationship between the position screw block and the rear nozzle block which are connected together with a flexible link wire.
FIG. 11 is a perspective, partially cross-sectional, view showing in detail that the position of the rear nozzle block is changed by mining a screw block knob.
FIG. 12 is a perspective, partially cross-sectional, view showing in detail that the position of the rear nozzle block is changed by pushing the screw block knob.
Figure 13:
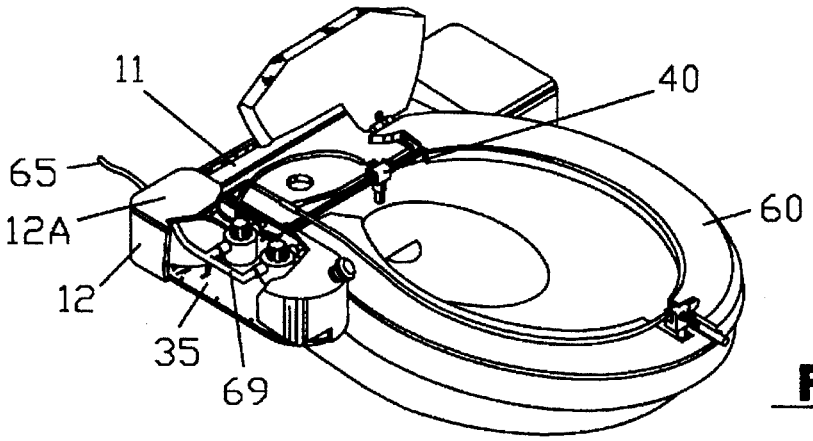
FIG. 13 is a perspective view showing in detail the relationship between the front and rear nozzle block and two valves with no water reservoir.

As shown in FIGS. 10 to 12, rear nozzle block 40 and position screw block 32 are connected together with a flexible link wire 38 to adjust the rear nozzle block 40 position by mining position screw block 32. Flexible link wire 38 is made with flexible hard tension wires and covered with a rubber tube 37 so that flexible link wire 38 is moveable through rubber tube 37 such as a brake wire on the bicycle. As handle shaft 31 is attached to screw block knob 30 and assembled to position screw block 32 with female screw 31A, position screw block 32 moves back and forth by taming screw block knob 30. the movement of position screw block 32 back and forth is transmitted to rear nozzle block 40 through flexible link wire 38. In order to enable the user to change and maintain the rear nozzle block 40 in the setting position, the user changes the location of position screw block 32 back and forth by turning the screw block knob 30 clock wise or counter-clock wise. As the handle shaft 31 is mounted to base mount block 34 with a knob spring 33, when pushing screw block knob 30 inward, position screw block 32 moves in back position with handle shaft 31 and when releasing screw block knob 30, position screw block 32 and handle shaft 31 return to the setting position by knob spring 33 force. These actions transmitted to rear nozzle block 40 through flexible link wire 38 swing rear nozzle block 40. The user can repeat to push and release the screw block knob 30 to spray water under the whole bottom area by swinging rear nozzle block 40 for a massage purpose. Bidet apparatus includes an upper nozzle valve 20 and a lower nozzle valve 21 mounted to extended portion 35 of base plate 11 and the valve shafts are extended out to the control panel 12A on the control box 12 and capped with nozzle knob 22,23. The force of water emerging from valves 20,21 is controlled by turning nozzle knob 22,23 clock wise or counter-clock wise. Upper nozzle valve 20 and lower nozzle valve 21 controls the water pressure for the genital and posterior areas respectively. Each of the valves 20, 21 has one valve inlet 24,25 and one valve outlet 26,27. All valve inlets 24,25 are jointed together and connected to water supply hose 69. Water supply hose 69 is connected to main water supply line 65 that is located under the toilet water tank 63 with T- main connector 64. Upper valve outlet 26 is connected to right water input shaft 47 on rear nozzle block 40 with upper water hose 28. Lower valve outlet 27 is connected to left water input shaft 46 on rear nozzle block 40 with lower water hose 29. For the present invention, a general type of manual on and off valve is used for both nozzle valves 20,21, however, which can be replaced with an electrical on and off valve. As shown in FIG. 4, toilet seat 60 has a space at the inside to attach two front support blocks 53 for the installation of front nozzle block 50 at the inside of the toilet seat 60, in the middle of the front area. The bottom area of the toilet seat between front support blocks 53 is opened 57 so that the from nozzle 52 can come out to in-use position. Front nozzle block 50 includes front nozzle shaft 51, front nozzle 52, front support blocks 53, front spring (not shown) and front water input shaft 54. Front water hose 29A is connected to the lower water hose 29 with T-connector 71 to supply water to the front water input shaft 54, which is connected to inside of front nozzle block 50. The inside of the front nozzle 52 is forming part of the water flow path up to the bottom area, where nozzle holes are existed toward inside of the toilet. Each of nozzle holes has an angle to direct a spray of water at the genital areas from the front side. When turn the water off with lower nozzle knob 23, the front nozzle 52 returns to a retracted position by the front spring force. The front nozzle 52 includes a guider to guide the center shaft linearly without rotation when it moves vertically between its in-use position and the retracted position. The spray of water direction can be changed by the setting position of front nozzle block 50. As the inside of front nozzle shaft 51 has a female screw and male screw shaft 55, male screw shaft 55 can push and pull the front nozzle block 50 by turning the from nozzle shaft 51 clock wise or counter-clock wise. A stopper keeps the front nozzle shaft 51 in the same position. As shown in FIG. 1, for the existing toilet seat, front nozzle block 50 can be eliminated.

Figure 14:
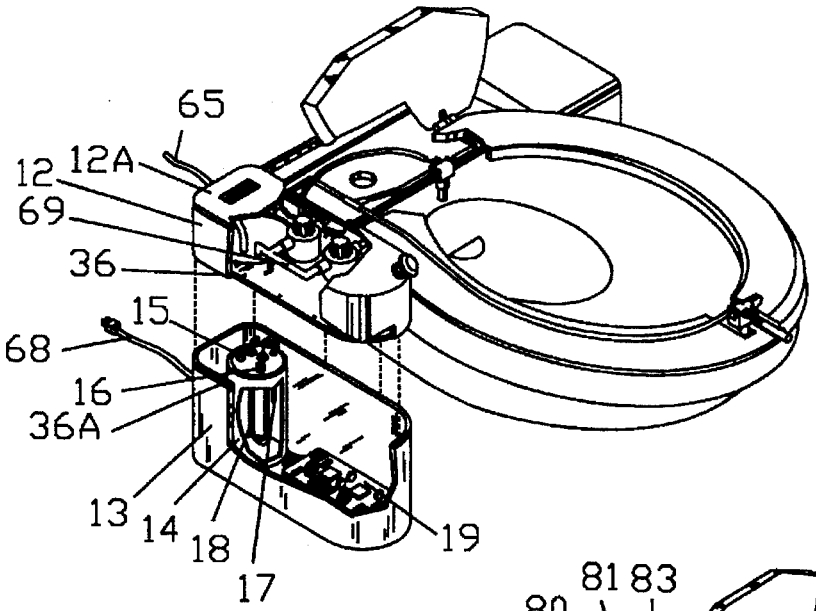
FIG. 14 is a perspective view showing in detail the way to attach under the extended portion of the base plate and the relationship between the from and rear nozzle block, two valves and a portion of the water reservoir equipped with a heater.
Figure 16:
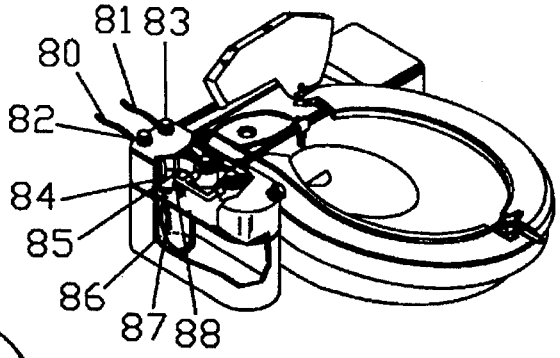
FIG. 16 is a perspective view showing in detail the relationship between the front and rear nozzle block, two valves and a portion of the water reservoir designed to mix hot and cold supply water instead of a heater.
Figure 15:
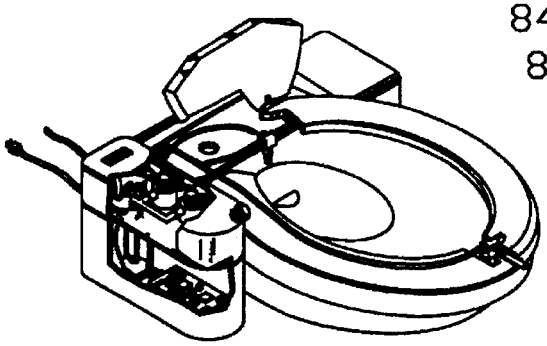
FIG. 15 is a perspective view showing the water reservoir equipped with a heater attached under the extended portion of the base plate.

It is contemplated to attach a water reservoir 14, located inside of a water reservoir box 13, to under the extended portion 35 of the base plate 11, bottom of the control box 12. Water reservoir 14 shown in FIGS. 14, 15 includes reservoir inlet 15, reservoir outlet 16, thermostat 17, heater 18 and electrical control board 19 to control and keep the spray of water temperature not to exceed 100° F. Reservoir inlet 15 is connected to main water supply line 65 that are available under the toilet water tank 63 with T-connector 71. Reservoir outlet 16 is connected to valve inlets 24,25. Water temperature is adjustable from the temperature control panel 76 on the control panel 12A. Temperature control panel 76, thermostat 17 and heater 18 are connected to an electrical control board 19 which is located in the water reservoir box 13 to control the electrical power for heater 18. It is also contemplated to install a different type of water reservoir 86 shown in FIG. 16 to utilize the normal hot water outlet instead of the heater. This water reservoir 86 includes hot reservoir inlet 84, cold reservoir inlet 85, hot water guider 87 and mixed reservoir outlet 88. Hot reservoir inlet 84 is connected to normal hot water outlet with hot water line 80 and hot water valve 82. hot water guider 87 is located inside of the water reservoir 86 and connected to hot water valve 82 to guide hot water to the bottom level of the water reservoir 86. Cold reservoir inlet 85 is connected to normal cold water outlet with cold water line 81 and cold water valve 83. Hot and cold water outlets are available in a bathroom. Mixed reservoir outlet 88 is connected to valve inlets 24,25 with water supply hose 69.

It may thus be seen that bidet apparatus of the present invention provides a simple and effective device by which a normal toilet may be converted into a bidet. Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the size, shape and arrangement of parts.

What is claimed is:

1. A bidet apparatus adapted to be fitted to a conventional toilet which includes a bowl having an upper horizontal rim surface and a toilet seat, comprising:

a base plate attachable to said upper horizontal rim surface;

a rear nozzle block pivotally mounted to said base plate and locatable under said toilet seat, said rear nozzle block having two separate water inlets connected to two separate nozzles, each nozzle having a plurality of holes to spray water at an angle at the posterior and genital areas, respectively, of a user, the position of said rear nozzle block being swingable via said pivotal mount, wherein one of said nozzles includes a lower nozzle shaft forming a water flow path connected to a respective one of said separate water inlets;

two valves mounted to said base plate, each of said valves having one inlet connectable to a pressurized water source and one outlet, each of said valve outlets being connected to a respective one of said separate water inlets, said valves being operative to control the rate of water flow for directing the spray of water at the genital and posterior areas;

conduit means for connecting said separate water inlets to said valve outlets;

position handle means mounted to said base plate and including a handle shaft moveable in back and forth motion for adjusting the position of said rear nozzle block; and link means connected between said rear nozzle block and said position handle means for moving said rear nozzle block to an in-use position in response to movement of said handle shaft.

2. The bidet apparatus as claimed in claim 1, wherein said conduit means includes a flexible hose connected to said valve outlets.

3. The bidet apparatus as claimed in claim 1, including a front nozzle block positionable at a front of said toilet seat, and connected to said conduit means.

4. The bidet apparatus as claimed in claim 1, wherein said position handle means further includes a screw block and a spring, said screw block being moveable back and forth by turning the handle shaft, said handle shaft being mounted to said base plate with said spring to allow said screw block to be moveable back and forth by pushing and releasing the handle shaft.

5. The bidet apparatus as claimed in claim 1, wherein said two separate nozzles include an upper nozzle and lower nozzle, said upper nozzle located in an upper area of said rear nozzle block with an angle for directing a spray of water at the posterior area and said lower nozzle located in an lower area with an angle for directing a spray of water at the genital area.

6. The bidet apparatus as claimed in claim 1, wherein said lower nozzle shaft includes a light spring, so that when water pressure is on, said lower nozzle shaft moves out from inside of said rear nozzle block to an in-use position directing a spray of water at the genital area, and when water pressure is off, said lower nozzle shaft moves back to inside of said rear nozzle block by the spring force.

7. A bidet apparatus adapted to be fitted to a conventional toilet which includes a bowl having an upper horizontal rim surface, comprising:

a base plate attachable to said upper horizontal rim surface;

a rear nozzle block pivotally mounted to said base plate, said rear nozzle block having two separate water inlets connected to two separate nozzles, each nozzle having a plurality of holes to spray water at an angle at the posterior and genital areas, respectively, of a user, the position of said rear nozzle block being swingable via said pivotal mount, wherein one of said nozzles includes a lower nozzle shaft forming a water flow path connected to a respective one of said separate water inlets;

two valves mounted to said base plate, each of said valves having one outlet and one inlet, each of said valve outlets being connected to a respective one of said separate water inlets, said valves being operative to control the rate of water flow for directing the spray of water at the genital and posterior areas;

conduit means for connecting said separate water inlets to said valve outlets;

position handle means mounted to said base plate and including a handle shaft moveable in back and forth motion for adjusting the position of said rear nozzle block;

link means connected between said rear nozzle block and said position handle means for moving said rear nozzle block to an in-use position in response to movement of said handle shaft;

a water reservoir mounted to said base plate and connectable to a pressurized water source, said water reservoir connected to said inlets of said valves, said water reservoir being made of plastic; and a toilet seat mountable on said upper horizontal rim surface, said toilet seat including a front opening and a front nozzle block pivotally mounted in the front opening, said front nozzle block including a position knob to change the position of said front nozzle block.

8. The bidet apparatus as claimed in claim 7, wherein said pressurized water source includes a water supply line of a toilet water tank, and said water reservoir includes one inlet having a T-connector connectable to the water supply line and two outlets connected to the inlets of said two valves respectively.

9. The bidet apparatus as claimed in claim 8, wherein said water reservoir includes a heater and a temperature sensor connected to an electric control board to control the water temperature.

10. The bidet apparatus as claimed in claim 7, wherein said pressurized water source includes hot and cold water outlets, and said water reservoir includes two inlets each having control valves connectable to the hot and cold water outlets and one outlet connected to said two valve inlets.

11. The bidet apparatus as claimed in claim 10, wherein said water reservoir includes water guiding means to guide hot water to the bottom level of said water reservoir and to guide cold water to the top level.

* * * * *